US008915565B2

(12) United States Patent
Klein Koerkamp et al.

(10) Patent No.: US 8,915,565 B2
(45) Date of Patent: Dec. 23, 2014

(54) METHOD FOR PRINTING MARKING MATERIAL ON A RECEIVING MEDIUM BY A PRINTING SYSTEM

(71) Applicant: OCE Technologies B.V., Venlo (NL)

(72) Inventors: Koen Joan Klein Koerkamp, Venlo (NL); Eduard T.H. De Grijs, Venlo (NL)

(73) Assignee: Oce-Technologies B.V., Venlo (NL)

( * ) Notice: Subject to any disclaimer, the term of this patent is extended or adjusted under 35 U.S.C. 154(b) by 0 days.

(21) Appl. No.: 13/946,090

(22) Filed: Jul. 19, 2013

(65) Prior Publication Data

US 2013/0300793 A1 Nov. 14, 2013

Related U.S. Application Data

(63) Continuation of application No. PCT/EP2012/050169, filed on Jan. 6, 2012.

(30) Foreign Application Priority Data

Jan. 21, 2011 (EP) ..... 11151670

(51) Int. Cl.
*B41J 2/21* (2006.01)
*B41J 2/205* (2006.01)
*B41J 29/393* (2006.01)

(52) U.S. Cl.
CPC ..... *B41J 2/2132* (2013.01); *B41J 2/2056* (2013.01); *B41J 29/393* (2013.01)
USPC ..... 347/15; 347/9; 347/14

(58) Field of Classification Search
CPC ..... B41J 2/2132; B41J 2/2128; B41J 2/0458; G06K 15/102; H04N 1/40087
See application file for complete search history.

(56) References Cited

U.S. PATENT DOCUMENTS

| | | | | |
|---|---|---|---|---|
| 4,719,506 | A | 1/1988 | Van Buren | |
| 6,178,008 | B1 | 1/2001 | Bockman et al. | |
| 6,588,879 | B2 * | 7/2003 | Kushner et al. | 347/43 |
| 6,799,823 | B2 * | 10/2004 | Miquel et al. | 347/15 |
| 7,760,937 | B2 * | 7/2010 | Ochs et al. | 382/167 |
| 2005/0213121 | A1 | 9/2005 | Chang | |

FOREIGN PATENT DOCUMENTS

| | | | |
|---|---|---|---|
| EP | 0590854 | B1 | 8/1997 |
| EP | 0590921 | B1 | 8/1998 |
| EP | 0675636 | B1 | 7/1999 |
| EP | 0983863 | B1 | 3/2003 |

* cited by examiner

*Primary Examiner* — Manish S Shah
*Assistant Examiner* — Jeremy Delozier
(74) *Attorney, Agent, or Firm* — Birch, Stewart, Kolasch & Birch, LLP

(57) ABSTRACT

A method obtains color consistency over at least one printing system in order to print a digital image containing pixels and color information of the primary colors per pixel. Each printing system includes at least one engine including a plurality of containers, each of the containers containing a marking material having a primary color. The method includes the steps of, for each primary color, determining a target color which is printable by each engine on the receiving medium, determining for each container how much marking material must be ejected to establish the target color, and for each pixel of the digital image to be printed by an engine, replacing each primary color of the pixel by a corresponding target color, and printing the pixel by ejecting marking material from the containers of the engine according to the determined marking material per target color per container of the engine.

6 Claims, 4 Drawing Sheets

METHOD FOR PRINTING MARKING MATERIAL ON A RECEIVING MEDIUM BY A PRINTING SYSTEM

CROSS-REFERENCE TO RELATED APPLICATIONS

This application is a Continuation of International Application No. PCT/EP2012/050169, filed on Jan. 6, 2012, and for which priority is claimed under 35 U.S.C. §120, and which claims priority under 35 U.S.C. §119 to Application No. 11151670.4, filed in Europe on Jan. 21, 2011. The entirety of each of the above-identified applications is expressly incorporated herein by reference.

BACKGROUND OF THE INVENTION

1. Field of the Invention

The present invention relates to a method for obtaining color consistency over at least one printing system in order to print a digital image containing pixels and color information of the primary colors per pixel, each printing system comprising at least one engine, the engine comprising a plurality of containers, each of which contains a marking material having a primary color.

Nowadays in the field of color printing, color consistency is an important issue. This means that strong requirements are placed on the color differences that may occur between different prints produced by one printing engine over a lapsed time period, between different prints produced on two or more printing engines within one printing system or between different prints produced on different printing systems.

Color differences may be caused, amongst other reasons, by differences in used colors of the marking material, such as ink or toner, merely due to refill times of the marking material or differences between produced batches of the marking material, or by a change of the colors of the marking material in time, for instance by pollution, by another color or selective development of, for instance, toner particles.

A significant cause of differences in colors of the marking material is a deviation in the primary colors when printed on the receiving medium, for example by pollution of the primary colors. Primary colors may be Cyan (C), Magenta (M), Yellow (Y), black (K), Red (R), Green (G), Blue (B) or White (W). A deviating primary color may be a combination of more than one primary color, which is originally contained in a corresponding container. Every color, consisting of amounts of primary colors from the containers, may deviate from the color intended to be printed according to the color information of the primary colors per pixel.

Each printing system has a color printer gamut, being the collection of colors of marking material, which are producible by the printing system. A problem when trying to print a same color on a plurality of printing systems is that the plurality of printing systems may have a different color printer gamut. Besides the differences in printer gamut, the colors finally printed on the receiving medium may also be determined by the degree of pollution of a primary color printable by the printing system.

SUMMARY OF THE INVENTION

The object of the present invention is to provide a method for printing a digital image on a receiving medium by a plurality of engines, so that each print has exactly the same colors despite the fact that primary colors printed by one engine deviate from the corresponding primary colors printed by another engine, due to a different printer gamut or due to pollution in the engines.

The object is achieved by a method comprising the steps of, for each primary color, determining a target color which is printable by each engine on the receiving medium, determining for each container how much marking material must be ejected to establish the target color, and for each pixel of the digital image to be printed by an engine, replacing each primary color of the pixel by a corresponding target color, and printing the pixel by ejecting marking material from the containers of the engine according to the determined marking material per target color per container of the engine.

The determination of the target colors may be executed by printing any image or before printing the current image to be printed.

Before printing colors with a printing system, color changes due to different mixing ratios between the primary colors from the containers may be calculated by saving results of experiments with the printing system. The calculations may be saved in memory of the printing system for later use by the printing system when printing colors of images.

In a first embodiment, the target colors are determined by executing a number of steps for each container before the actual printing of colors takes place. In a first step, a full coverage area of marking material from a container is printed. The color gamut of the printing system is not equal to a total color space. Moreover, a primary color which is printed on the receiving medium may deviate from the original primary color present in the corresponding container. Therefore, in a second step the color of the full coverage area is measured. By doing so, a possible pollution of a primary color is also taken into account in the measuring step. A colorimeter or any other suitable measuring device may be used to measure the colors and output a decomposition of the measured color into primary colors of the marking material present in the containers. In this way, the measured primary color may be determined to be a mix of ratios of the primary colors of the marking material present in the containers. Implicitly, the mix of ratios determines for each container how much marking material must be ejected to establish a target color.

In further steps of the method, pixels of an image are going to be printed by an engine. For each pixel of the image to be printed by the engine, the primary colors of the pixel are substituted by a corresponding mix of target colors. By doing so, it is assured that each pixel can be printed by each engine and exactly the same color may be established on the receiving medium for each engine. In a last step of the method, the pixel is printed by ejecting marking material from the containers of the engine on the receiving medium according to the determined marking material per target color per container of the engine.

According to an embodiment of the method, each target color is determined by taking a worst case color printable by each engine. This is advantageous when a printing system has to print the same colors in relation to for instance a large population of engines. Here, the colors to be printed must be the same for all engines, which implies that the accuracy of the determination of the target colors has to be high. By taking a worst case polluted color, it is assured that each engine can actually print the target color.

According to an embodiment of the method, each engine comprises a calibration card comprising colors corresponding to the primary colors to be printed, and for each primary color, the target color is determined by measuring the corresponding color from the calibration card and taking the measured color as the target color for the corresponding primary color.

The present invention is also directed to a printer comprising a processor unit and a print engine, wherein the processor unit is configured to carry out the determining and replacing steps of the method according to any of the preceding embodiments of the method according to the present invention and the print engine is configured to carry out the printing step of the method according to any of the preceding embodiments of the method according to the present invention.

The present invention is also directed to a computer program comprising computer program code embodied on a non-transitory computer readable medium to enable a printer according to any of the printer embodiments of the present invention in order to execute the method of any of the preceding embodiments according to the present invention.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

The embodiments of the method are explained by taking in the examples an ink jet printer as a printer comprising a print head with nozzles as printing elements but are not limited to these choices. In principal, any other printer using any of the suitable marking materials may use the methods according to the embodiments of the present invention.

Figure 1:
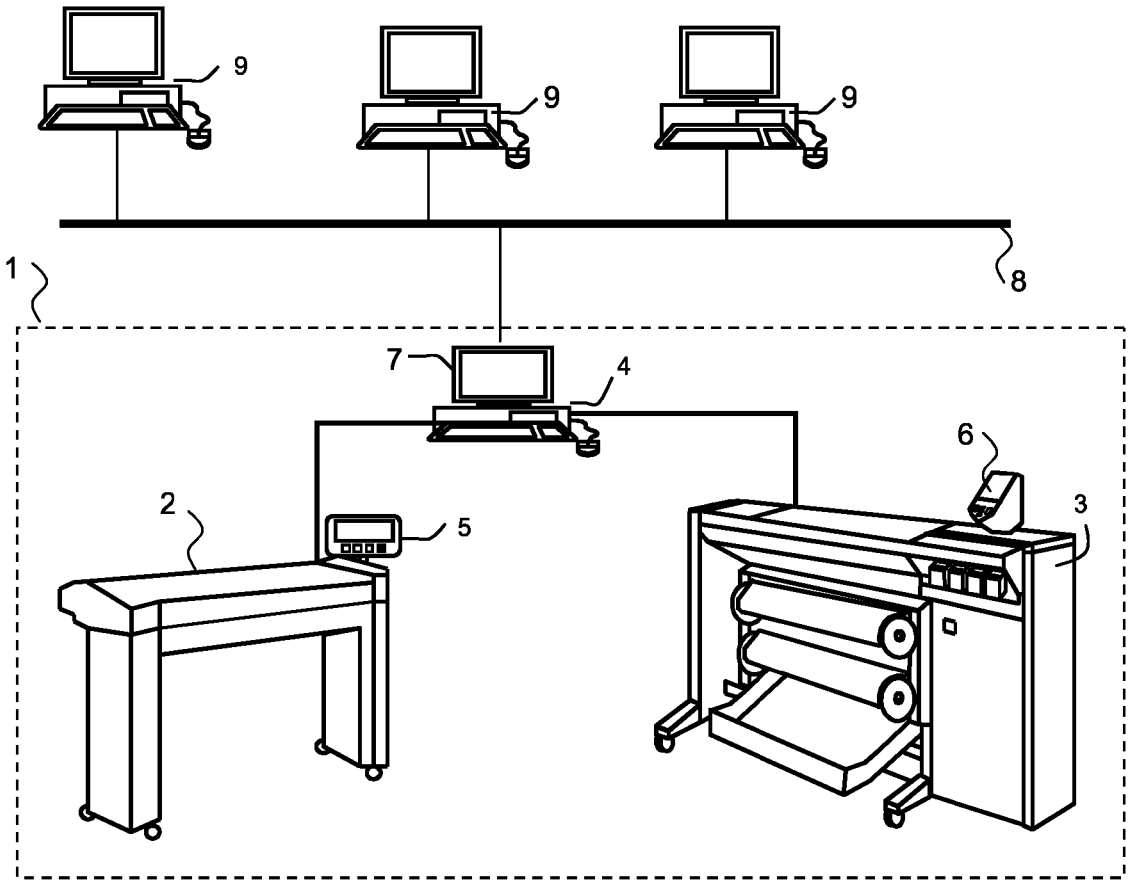
FIG. 1 is a schematic diagram of an environment comprising a reprographic system.

FIG. 1 is a schematic diagram of an environment which comprises a first reprographic system 1. The first reprographic system 1 as presented here comprises a scanning device 2, a printing device 3 and a control unit 4. The control unit 4 is connected to a network 8 so that a number of client computers 9, also connected to the network 8, may make use of the first reprographic system 1.

The scanning device 2 is provided for scanning an image carrying object. The scanning device 2 may be provided with a color image sensor (i.e. a photoelectric conversion device) which converts the reflected light into electric signals corresponding to the primary colors red (R), green (G) and blue (B). The color image sensor may be for example a CCD type sensor or a CMOS type sensor. A local user interface panel 5 is provided for starting scan and copy operations.

The printing unit 3 is provided for printing images on image receiving members. The printing unit may use any kind of printing technique. It may be an inkjet printer, a pen plotter, or a press system based on electro-(photo)graphical technology, for instance.

The inkjet printer may be for example a thermal inkjet printer, a piezoelectric inkjet printer, a continuous inkjet printer or a metal jet printer. A marking material to be disposed may be a fluid like an ink or a metal, or a toner product. In the example shown in FIG. 1, printing is achieved using a wide format inkjet printer provided with four different basic inks, such as cyan, magenta, yellow and black. The housing contains a print head which is mounted on a carriage for printing swaths of images. The images are printed on an ink receiving medium such as a sheet of paper supplied by a paper roll. A local user interface panel 6 may be provided with an input device such as buttons. The housing may contain a plurality of print heads, e.g. staggered or parallel print heads.

The scanning device 2 and the printing device 3 are both connected to the control unit 4. The control unit 4 executes various tasks such as receiving input data from the scanning device 2, handling and scheduling data files, which are submitted via the network 8, controlling the scanning device 2 and the printing device 3, converting image data into printable data, etc. The control unit 4 is provided with a user interface panel 7 for offering the operator a menu of commands for executing tasks and making settings.

Figure 2:
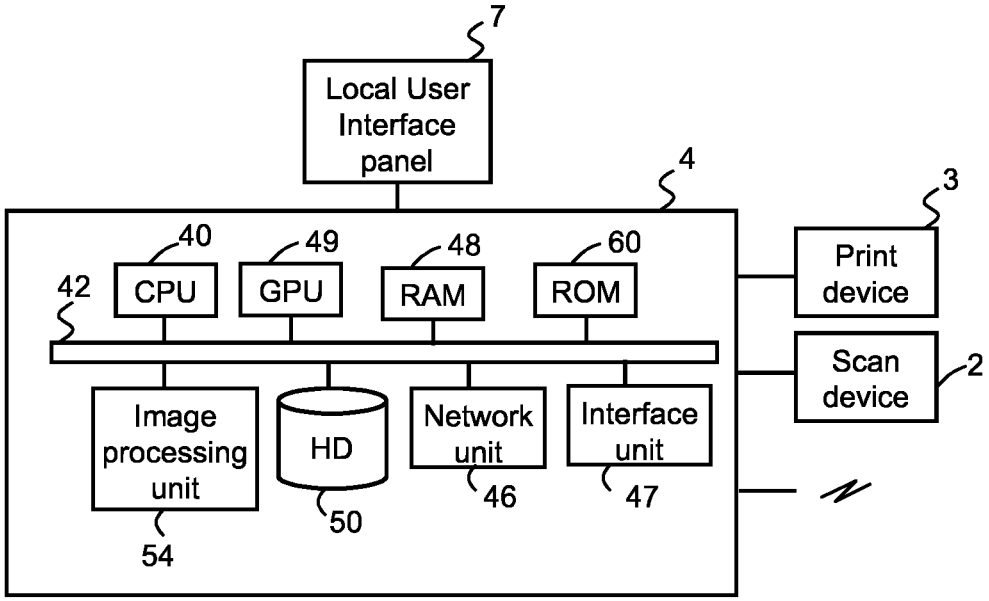
FIG. 2 is a schematic diagram of an environment comprising a control unit of the reprographic system.

An embodiment of the control unit 4 is presented in FIG. 2 in more detail. As shown in FIG. 2, the control unit 4 comprises a Central Processing Unit (CPU) 40, a Graphical Processor Unit (GPU) 49, a Random Access Memory (RAM) 48, a Read Only Memory (ROM) 60, a network unit 46, an interface unit 47, a hard disk (HD) 50 and an image processing unit 54 such as a Raster Image Processor (RIP). The aforementioned units 40, 49, 48, 60, 46, 47, 50, 54 are interconnected through a bus system 42. However, the control unit 4 may also be a distributed control unit. The hard disk 50 may also be any kind of solid state disk.

The CPU 40 controls the respective devices 2, 3 of the control unit 4 in accordance with control programs stored in the ROM 60 or on the HD 50 and the local user interface panel 7. The CPU 40 also controls the image processing unit 54 and the GPU 49.

The ROM 60 stores programs and data such as boot program, set-up program, various set-up data or the like, which are to be read out and executed by the CPU 40.

The hard disk 50 is an example of a non-volatile storage unit for storing and saving programs and data which make the CPU 40 execute a print process to be described later. The hard disk 50 also comprises an area for saving the data of externally submitted print jobs. The programs and data on the HD 50 are read out onto the RAM 48 by the CPU 40 as needed. The RAM 48 has an area for temporarily storing the programs and data read out from the ROM 60 and HD 50 by the CPU 40, and a work area which is used by the CPU 40 to execute various processes.

The interface card 47 connects the control unit 4 to scanning device 2 and printing device 3.

The network card 46 connects the control unit 4 to the network 8 and is designed to provide communication with the workstations 9, and with other devices reachable via the network.

The image processing unit 54 may be implemented as a software component running on an operation system of the control unit 4 or as a firmware program, for example embodied in a field-programmable gate array (FPGA) or an application-specific integrated circuit (ASIC). The image processing unit 54 has functions for reading, interpreting and rasterizing the print job data. Said print job data contains image data to be printed (i.e. fonts and graphics that describe the content of the document to be printed, described in a Page Description Language or the like), image processing attributes and print settings.

Basic modes of operation for the reprographic system are scanning, copying and printing.

With the electric signals corresponding to the primary colors red (R), green (G) and blue (B) obtained during scanning, a digital image is assembled in the form of a raster image file. A raster image file is generally defined to be an array of regularly sampled values, known as pixels. Each pixel (picture element) has at least one value associated with it, generally specifying a color or a shade of grey which the pixel should be displayed in. For example, the representation of an image may have each pixel specified by three 8 bit (24 bits total) values (ranging from 0-255) defining the amount of R, G, and B respectively in each pixel. In the right proportions, R, G, and B can be combined to form black, white, shades of grey, and an array of colors.

The digital image obtained by the scanning device 2 may be stored on a memory of the control unit 4 and be handled according to a copy path, wherein the image is printed by the print device 3. Alternatively, the digital image may be transferred from the control unit 4 to a client computer 9 (scan-to-file path). A user of the client computer 9 may decide to print a digital image, which reflects the printing mode of operation of the system.

In the example used hereinafter to illustrate the embodiments of the method according to the invention, a primary color cyan is assumed only to be polluted with magenta and black. In general, any other primary color than cyan, which is used when printing by means of the reprographic system according to FIG. 1 may be part of the pollution of the primary color cyan, for example yellow, white, red and blue.

Figure 3:
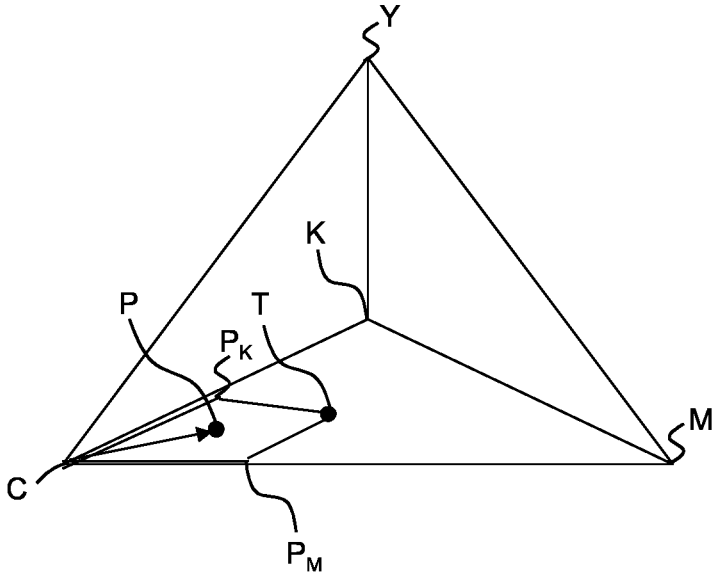
FIG. 3 is a schematic diagram of a color space comprising target colors.

FIG. 3 shows a schematic diagram of a color space of the reprographic system in a form of a tetraeder or tetrahedron comprising four corners C, M, Y, K, representing the original primary colors cyan C, magenta M, yellow Y and black K, respectively. The color white has been left out for convenience reasons of displaying the color space. For each color printable by the reprographic system, the original primary colors are determinable. Moreover, the components of the original primary colors in a three-dimensional representation of the color space are over-determined, if the number of original primary colors is more than three. However, due to common applied print strategies of the reprographic system, like undercolor removal and grey component replacement, and due to taking into account the kind of the receiving medium and/or the kind of marking material, the components may be unambiguously derived.

The original primary colors C, M, Y, K are primary colors that are present in the corresponding containers and that the reprographic system is able to print when the primary colors are not polluted during printing the marking material from the container on the receiving medium. Due to any kind of pollution, the color of cyan C, once printed on the receiving medium, is shifted in the direction of the corners M and K towards a point P of the polluted cyan $C_p$. In general, the cyan color may shift in as many directions as there are other primary colors in the color space, which may have an influence on the pollution of the cyan color.

Figure 4:
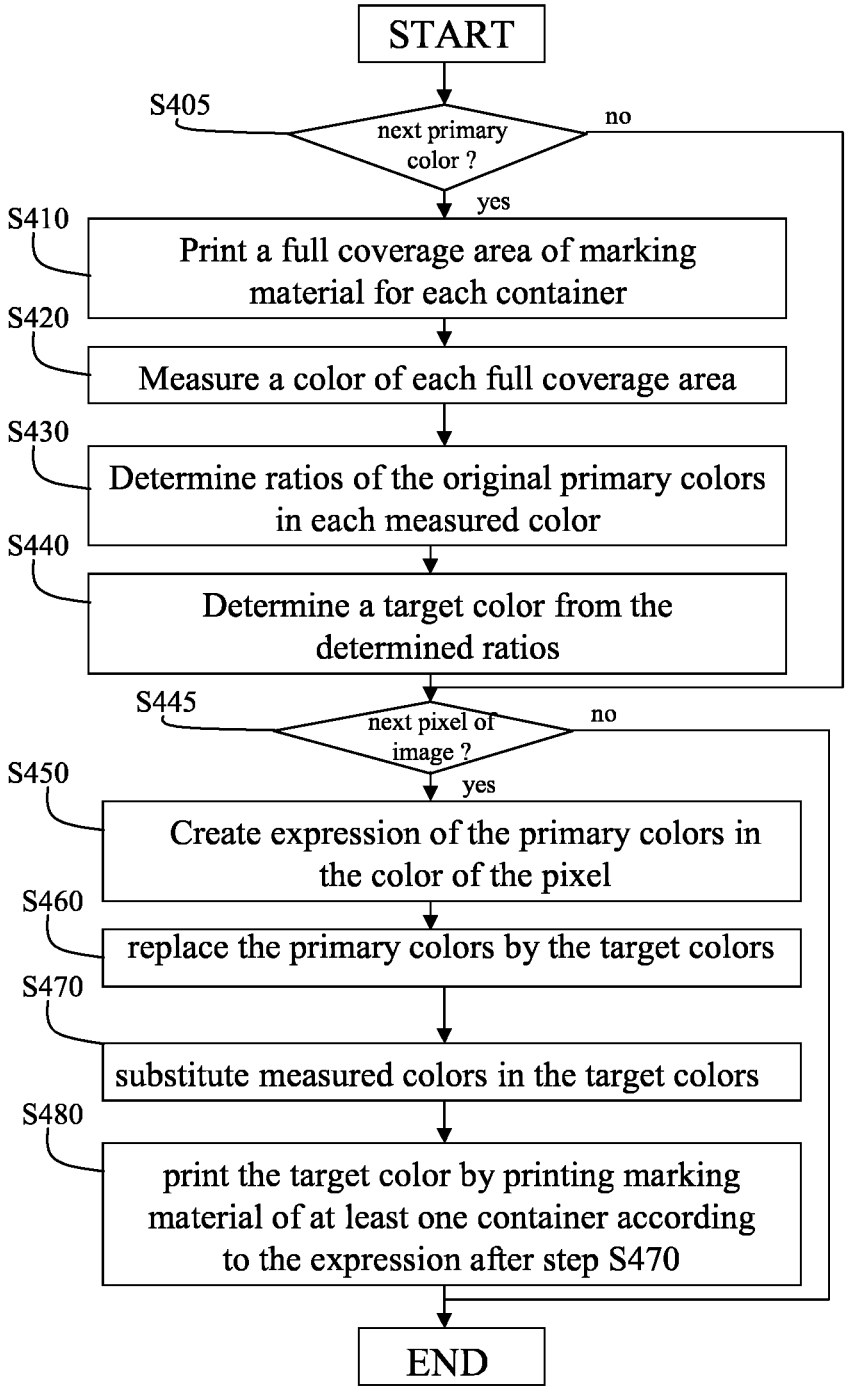
FIG. 4 is a flow diagram of an embodiment of the method according to the present invention.

FIG. 4 is a flow diagram of the method according to a first embodiment. In the first embodiment, the method is used when a printing system has to print the same colors in relation to a large population of printing systems. In that case, a target color must be the same for all the printing systems.

For each primary color, a number of steps S410, S420, S430 are executed in order to establish the target color corresponding to the primary color. The steps S410, S420, S430 are explained below for the primary color cyan.

In a first step S410, a full coverage area of the original marking material of cyan is printed by each of the printing systems.

In a second step S420, the color of the full coverage area of the original marking material cyan is measured by any suitable color measurement device, for example, a colorimeter. Since the target color must be the same for all printing systems, the measurement of the printed color cyan of the full coverage area must be highly accurate.

In a third step S430, ratios of original primary colors present in the measured color are determined. The measurement device may save each measured color as a digital value or as a multiple digital primary color decomposition, for example an RGB color or a CMYK color. The ratios are easily derived from the decomposition.

In a fourth step S440, a target primary color is determined from the determined ratios in the third step S430, which target primary color is printable by the printing system.

In the first embodiment, the target primary color for cyan is determined by taking a worst case deviating cyan from the measured cyan colors of the printing systems. The worst case deviating cyan may be arrived at by taking the maximum of each of the ratios of each of the primary colors in the multiple digital primary color decompositions. In this way, each printing system is able to print the target primary color with a mix of its own original primary colors.

In another embodiment of the method, a special calibration card is delivered together with each engine. The card comprises target colors corresponding to the primary colors. A target primary color is measured from the card and put in the memory of the engine or a control unit connected to the engine. A scanner, being a module of the engine, may be used for the measuring.

In advance, color changes may be calculated which result from different mixing ratios between cyan C, magenta M and black K. This may be saved in a table in the memory of the printing system under investigation. By means of this table, a mixing ratio may be derived which is needed that comprises the original marking material to reach the measured cyan color $C_p$.

For convenience reasons, a primary color like cyan is taken as a primary color to be printed and measured in the steps of S410-S440. In FIG. 3, the color cyan $C_p$ printed on a receiving medium according to printing step S410 is for instance polluted with 8% magenta and 4% black. The composition of the polluted cyan marking material $C_p$ in the original primary colors cyan C, magenta M and black K is measured according to step S420. According to step S430, formula (1) describes the composition:

$$C_p=c_cC+m_cM+k_cK \tag{1}$$

wherein $c_c$=0.88, $m_e$=0.08 and $k_c$=0.04 are the ratios of the respective original primary colors C, M, K. Summarization of the ratios $c_c$, $m_c$, $k_c$ delivers 1.

Formula (1) may be derived for all deviating primary colors $C_p$, $M_p$, $K_p$ to be printed, resulting in formula (2) below:

$$C_p=c_cC+m_cM+k_cK$$

$$M_p=c_mC+m_mM+k_mK$$

$$K_p=c_kC+m_kM+k_kK \tag{2}$$

This may be expressed by a matrix multiplication of an 'original' vector (C, M, K) with a 3×3 matrix R of all ratios $c_c$, $m_c$, $k_c$, $c_m$, $m_m$, $k_m$, $c_k$, $m_k$, $k_k$ leading to a deviating vector ($C_p$, $M_p$, $K_p$). In the case of n primary colors, the matrix R of ratios is expressible as an n×n matrix.

By taking the inverse matrix Inv(R) of ratio matrix R, the original vector (C, M, K) may be expressed in terms of the target vector ($C_p$, $M_p$, $K_p$). This means that each original primary color may be expressed in terms of the deviating primary colors.

In a next step, a target color is determined for all primary colors. For example, a target cyan color $C_t$ is represented as point T in FIG. 3. This color $C_t$ is the color of the marking material, which could be reached with a worst case pollution of the engines. In practice the polluted color of each printing system may be a point P between the point T and the point C in an area depicted as a four corner area $CP_MTP_K$ in FIG. 3. By the construction of the target color from the previous measurements, ratios $c_{ct}$, $m_{ct}$, $k_{ct}$ of each original primary color marking material C, M, K in the target color $C_t$ are known, for example see formula (3) below:

$$C_t=c_{ct}C+m_{ct}M+k_{ct}K \tag{3}$$

wherein $c_{ct}$=0.82, $m_{ct}$=0.12 and $k_{ct}$=0.06 are the ratios of the respective original primary colors. Summarization of the ratios $c_{ct}$, $m_{ct}$, $k_{ct}$ also delivers 1. In this example, the primary colors magenta and black were not polluted, thus $M_p$=M and $K_p$=K. The ratio $c_{ct}$ may be calculated by taking the maximum of the ratios $c_c$, $c_m$ and $c_k$. The ratio $m_{ct}$ may be calculated by taking the maximum of the ratios $m_c$, $m_m$ and $m_k$. The ratio $k_{ct}$ may be calculated by taking the maximum of the ratios $k_c$, $k_m$ and $k_k$.

In next steps S450, S460, S470 of the method, a pixel of an image is selected to be printed, having color information of the primary colors.

In a fifth step S450, the ratios of the original primary colors being present in the color of the pixel are established. The ratios are derived from the color information of the pixel.

In a sixth step S460, each original primary color in the color of the pixel is replaced by the corresponding target color. A ratio of each target color is the same as the ratio of the corresponding primary color before the replacement.

For each engine, the deviation of each original primary color printed by the engine on the receiving medium is known from the previous steps S410-S440. Therefore, in a seventh step S470 the color of the pixel is expressed in the deviating primary colors from the engine. This can be achieved by a simple substitution of color compositions as explained hereinafter.

In formula (3), the original primary colors may be substituted by the expressions of ratios of deviating primary colors derived from the inverse matrix Inv(R) for each engine. In this way, the target primary color $C_t$ is expressed in ratios of the deviating primary colors $C_p$, $M_p$, $K_p$ of each engine.

Since each engine under investigation is able to print the corresponding deviating primary colors $C_p$, $M_p$, $K_p$, the target color cyan is mixable and established according to the ratios of the inverse matrix Inv(R) and is printable by all engines under investigation. Printing by an engine takes place in an eighth step S480.

A simplified embodiment of the method may be applied, since the diagonal elements $c_c$, $m_m$, $k_k$ of the ratio matrix R are closer to one than to zero and the other ratios $m_c$, $k_c$, $c_m$, $k_m$, $c_k$, $m_k$ are closer to zero than to one. For the simplified embodiment of the method, formula (1) is rewritten in the following way:

$$C=(1/c_c)C_p-(m_c/c_c)M-(k_c/c_c)K \tag{1a}$$

Substituting (1a) in (3):

$$C_t=c_{ct}(1/c_c)C_p-(m_c/c_c)M-(k_c/c_c)K)+m_{ct}M+k_{ct}K <=>$$

$$C_t=c_{ct}/c_cC_p+(m_{ct}-m_cc_{ct}/c_c)M+(k_{ct}-k_cc_{ct}/c_c)K \tag{4}$$

By formula (4), the target cyan $C_t$ is expressed in ratios of the deviating cyan $C_p$ and the other original primary colors M, K. The values of the ratios $c_c$, $m_c$, $k_c$ of formula (1) and the ratios $c_{ct}$, $m_{ct}$, $k_{ct}$ of formula (3) may be substituted in formula (4) to arrive at formula (5):

$$C_t=0.932C_p+0.045M+0.023K \tag{5}$$

In this way, the color correction maps the deviating color cyan $C_p$ on the target color cyan $C_t$. The difference between the measured deviation of the color cyan $C_p$ and the deviation of the target color $C_t$ are digitally added. In the above examples of ratio values in the full coverage areas of cyan $C_p$, 6% of cyan $C_p$ has to be replaced with approximately 4% magenta M and approximately 2% black K. No matter the amount of deviation of the cyan $C_p$ in in the four corner area $CP_MTP_K$ of FIG. 3, this correction will result in the target color $C_t$ on paper if a full area of the corrected cyan is printed according to formula (5).

When a fraction of cyan $C_p$ is needed on paper for a certain color, the amount of correction may scale linear with this fraction. Thus, a mixing color of 50% cyan $C_p$ and 50% magenta M will be replaced with approximately 47% deviating cyan $C_p$, approximately 52% magenta M and approximately 1% black K.

In an embodiment, the method described hereinabove is executed partially by limiting the correction to a maximum pollution of each primary color. If the pollution of a primary color is more than the maximum, no correction takes place any more. Then, the correction is clipped at the limit of the maximum. Moreover, if the pollution is much more than the maximum, it may be an option to replace or replenish the marking material by a new batch of marking material or a new cartridge of marking material.

According to another embodiment, a plurality of engines $E_1$, $E_2$ are placed in one printing system. In this case the accuracy of these engines $E_1$, $E_2$ in relation to each other may be more critical than the accuracy between the printing system and other printing systems. The same method flow chart as in FIG. 4 is applied. However in the fourth step S440 the determination of the target primary color from the determined ratios is different from the determination according to the first embodiment.

When both engines are used for printing the same document, for example odd pages by the first engine and even pages by the second engine, the same colors within the document need to be obtained. In this embodiment, only the color differences between the two engines $E_1$, $E_2$ are used to determine target colors and the corrections of the deviating primary colors. Taking into account only those color differences implies that the measurement accuracy needed in a measuring step is easier to obtain than the accuracy needed in the previous embodiment of a plurality of printing systems.

The first step S410, the second step S420 and the third step S430 are carried out for each container of the plurality of engines $E_A$, $E_B$, containing a primary color. The first three steps S410, S420, S430 result, for example, in the following formulas:

$$C1_p=c1_cC+m1_cM+k1_cK \tag{1A}$$

$$C2_p=c2_cC+m2_cM+k2_cK \tag{1B}$$

wherein $C1_p$ is the deviating cyan color of the first engine $E_A$, $C2_p$ is the deviating cyan color of the second engine $E_B$, and $c1_c$, $m1_c$ and $k1_c$ are the ratios of the respective original primary colors C, M, K in the first deviating cyan color $C1_p$ is, and $c2_c$, $m2_c$ and $k2_c$ are the ratios of the respective original primary colors C, M, K in the second deviating cyan color $C2_p$.

The fourth step S440 according to the embodiment of the method is slightly different from the fourth step according to the previous embodiment of the method. The target color is determined from the ratios $c1_c$, $m1_c$, $k1_c$, $c2_c$, $m2_c$, $k2_c$ in formula (1A) and (1B) in the following way:

$$C_t=c_{ct}C+m_{ct}M+k_{ct}K \quad (3AB)$$

wherein the ratios $c_{ct}$, $m_{ct}$ and $k_{ct}$ are established by taking $c_{ct}=1-m_{ct}-k_{ct}$, $m_{ct}=\max(m1_c, m2_c)$ and $k_{ct}=\max(k1_c, k2_c)$.

Equations may be derived from the formulas (1A), (1B) and (3AB) to reach an expression of the target color $C_t$ in each of the deviating colors $C1_p$, $C2_p$ analogue to the derivation according to the previous embodiment. This results in:

$$C_t=c_{ct}/c1_c C1_p+(m_{ct}-m1_c c_{ct}/c1_c)M+(k_{ct}-k1_c c_{ct}/c1_c)K \quad (4A)$$

$$C_t=c_{ct}/c2_c C2_p+(m_{ct}-m2_c c_{ct}/c2_c)M+(k_{ct}-k2_c c_{ct}/c2_c)K \quad (4B)$$

Cyan color $C1_p$ of engine $E_A$ may be polluted with 8% magenta M and 4% black K, while the cyan color $C2_p$ of engine $E_B$ is unpolluted. To obtain the same color for the two engines $E_A$, $E_B$ the color cyan of the second $E_B$ may be digitally changed so that 88% cyan C, 8% magenta M and 4% black K is printed, while in this situation, the cyan color of the first engine $E_A$ remains unchanged. If the cyan colors of both engines change, it is necessary to change the mixing ratios of both engines according to formulas (4A) and (4B). The needed amount of correction in this embodiment may usually be less than the amount of correction according to the previous embodiment, because only color differences between these two engines $E_A$, $E_B$ have to be eliminated.

The steps S450-S470 are analogue to the previous embodiment.

In the last and eighth step S480, the color of the pixel is printed by at least one of the engines $E_A$, $E_B$. If pixels are printed by both engines on the respective receiving mediums, they will have exactly the same color on the receiving medium for both engines.

For convenience reasons, the formulas 1, 2, 3, 1a, 4, 1A, 1B, 3AB, 4A, 4B are shown for the three colors C, M and K. The formulas can be generalized and expanded for more colors than the colors C, M, K, for example four colors C, M, Y, K, five colors C, M, Y, K, W, and seven colors C, M, Y, K, R, G, B.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A method for obtaining color consistency over at least one printing system in order to print a digital image containing pixels and color information of the primary colors per pixel, each printing system comprising at least one engine, the engine comprising a plurality of containers, each of the plurality of containers containing a marking material having a primary color, said method comprising the steps of, for each primary color:

determining a target color that is printable by each of the at least one engine on a receiving medium, the target color being derived from a color measured when printing a full coverage area from a container with marking material of the primary color;

determining, for each of the plurality of containers, how much marking material must be ejected to establish a target color; and for each pixel of the digital image to be printed by an engine:

replacing each primary color of the pixel by a corresponding target color; and printing the pixel by ejecting marking material from the plurality of containers of the engine according to the determined marking material per target color per container of the engine.

2. The method according to claim 1, wherein each target color is determined by taking a worst case color that can be printable by each of the at least one engine of a plurality of engines in order to assure that each engine of the plurality is able to print the target color, the worst case color being defined by a maximum of each of ratios of each of the primary colors in a multiple digital primary color decomposition of the measured color.

3. The method according to claim 1, wherein each of the at least one engine comprises a calibration card comprising colors corresponding to the primary colors to be printed and the method further comprises the step of determining for each primary color the target color by measuring the corresponding color from the calibration card and taking the measured color as the target color for the corresponding primary color.

4. The method according to claim 2, wherein each of the at least one engine comprises a calibration card comprising colors corresponding to the primary colors to be printed and the method further comprises the step of determining for each primary color the target color by measuring the corresponding color from the calibration card and taking the measured color as the target color for the corresponding primary color.

5. A printer comprising a processor unit and a print engine, wherein the processor unit is configured to carry out the determining and replace steps and the print engine is configured to carry out the printing step of the method according to claim 1.

6. A computer program comprising computer program code embodied on a non-transitory computer readable medium to enable a printer to execute the method of claim 1.

* * * * *